US005791438A

United States Patent [19]

Kempton

[11] Patent Number: 5,791,438

[45] Date of Patent: Aug. 11, 1998

[54] ADJUSTABLE PLATFORM FOR SUPPORTING LADDERS

[75] Inventor: John D. Kempton, El Sobrante, Calif.

[73] Assignee: John Kempton, El Sobrante, Calif.

[21] Appl. No.: 752,464

[22] Filed: Nov. 18, 1996

[51] Int. Cl.[6] ..... E06C 7/44

[52] U.S. Cl. ..... 182/200; 182/45

[58] Field of Search ..... 182/200, 107, 182/111, 108, 45; 248/371, 396

[56] References Cited

U.S. PATENT DOCUMENTS

| | | | |
|---|---|---|---|
| 4,342,374 | 8/1982 | Montana | 182/200 |
| 4,699,247 | 10/1987 | Clarke | 182/107 |
| 4,852,689 | 8/1989 | Erion | 182/204 |
| 5,078,231 | 1/1992 | Davis | 182/107 |
| 5,222,575 | 6/1993 | Santos | 182/108 |
| 5,307,900 | 5/1994 | Noga | 182/204 |
| 5,464,071 | 11/1995 | Rice | 182/205 |
| 5,507,364 | 4/1996 | Spevak | 182/200 |
| 5,584,535 | 12/1996 | Jacobson | 248/371 |
| 5,615,752 | 4/1997 | Wassil | 182/200 |

FOREIGN PATENT DOCUMENTS

| | | | |
|---|---|---|---|
| 1138903 | 10/1962 | Germany | 182/108 |
| 977624 | 12/1964 | United Kingdom | 182/200 |

*Primary Examiner*—Alvin C. Chin-Shue

[57] ABSTRACT

Abstract An improved ladder supporting device having two similar rectangular plates, hinged together at one end of each plate. One plate can be raised to an angular configuration with the other plate and sustained by a pair of support racks. The support racks are pivotal upon the base plate edges and are slotted and notched so that the load-bearing plate can rest in any of a plurality of angular configurations. The angular resting position of the load bearing plate is secured by a pair of locking wing nuts. In this configuration, the device can compensate for the sloping condition of the footing surface and support the combined weight of the ladder, the worker, and his or her working tools. By spreading the total weight over an enlarged area, the device can be used over a variety of unstable sloped ground conditions. In like manner, this device can be used, in its collapsed configuration, over level unstable ground surface conditions.

1 Claim, 3 Drawing Sheets

ADJUSTABLE PLATFORM FOR SUPPORTING LADDERS

BACKGROUND

1. Field of the Invention

This invention relates to ladders, specifically a stabilizing platform for use with ladders placed on loose materials and sloping surfaces.

2. Description of the Prior Art

Companies commonly use employees to perform work which requires the use of ladders. Occasionally these workers encounter unstable conditions at the location where the ladder feet must be placed. This unstable area may be composed of loose soil, sand, or gravel, which could be either flat or sloping. In areas of brush or other vegetation, the instability may be further aggravated by moist spongy soil or the accumulation of leaf mulch or debris. During winter months, instability can also be caused by ice-crusted ground surface.

The worker is then faced with the need to stabilize the footing area in order to safely place the ladder feet. This generally requires a search for some solid materials, such as boards, blocks, bricks, or plywood, or anything else which is available to provide a temporary solid foundation. The more unstable the ground condition, the greater the urgency to provide a stable footing for the ladder. All too often, there are no suitable materials readily available for use in stabilizing the footing area. This leaves the worker in a situation wherein he or she must decide to risk working on an unsteady or tilted ladder or abandoning the work and so informing the job supervisor. If the worker opts to continue working using an unsteady ladder, the quality of work performance can suffer. More importantly, the risk of injury increases significantly. In any event, valuable time will be consumed which can impact the performance of the ensuing tasks to which the worker has been assigned.

Many inventors have addressed the unstable ladder problem, but mainly have focused on the sloping-ground aspect. They have conceived various types of ladder supporting devices, both permanently or temporarily attached to the ladder, to compensate for a sloping footing. However, it appears that, do to their preoccupation with the sloping-ground approach, they have overlooked the most important aspect of ladder instability, namely the condition of the footing area. Therefore, while these ladder levelers or stabilizers are capable of providing adequate slope correction and support on solid footing, they become barely useable or useless over unstable surfaces. Typical examples of this approach are shown in U.S. Pat. Nos. 5,307,900 to Noga (1993), 5,507,364 to Spevak (1994), 5,464,071 to Rice (1995), 5,222,575 to Santos (1991), and 4,852,689 to Erion (1987). All of these devices provide possitionable ground support in the form of small circular or small rectangular feet. U.S. Pat. No. 4,699,247 to Clarke (1985) does show a platform-style supporting member upon which the ladder can rest. Compensation for slope is made by using three "ground-engaging" pegs. The leveling action requires considerable manipulation of the pegs. Furthermore, the pegs are useless on soft surfaces and thus the platform can sink and assume the slope of the ground surface. U.S. Pat. No. 5,078,231 to Davis (1991) also notes that small ladder feet can sink into soft surfaces by showing a large flat plate of considerable area. However, this ladder support attachment has no means for accommodating lateral sloping surfaces, which severely limits its usefulness.

Similar analysis and commentary is applicable to a large number of other ladder levelers or stabilizers. All, except the last two noted, suffer one major disadvantage. That is, they are susceptible to sinking into soft or unstable surface materials. The reason is that their small support feet, averaging approximately 80 square centimeters of ground contact area each, can sink into or compress most non-solid surfaces. Following is a typical example of weight distribution using these small feet. Assuming a hypothetical worker of 88 kilograms, a ladder weight of 20 kilograms and working tools of 5 kilograms, the gross weight totals 113 kilograms. This load, bearing upon a surface area of 160 square centimeters, results in a ground pressure of 0.7 kilogram per square centimeter.

OBJECTS AND ADVANTAGES

Accordingly, the main objects of the present invention are:

To provide an improved ladder supporting device;

To provide a ladder support which can safely support a typical combination of ladder and worker weight;

To provide a ladder support with a greater measure of safety when used over unstable level ground or unstable sloping ground;

To provide a ladder support which distributes the working load over a broad base area;

To provide a ladder support which prevents ladder feet from sinking into soft soil.

Additional objects of the invention are:

To provide a ladder support which has anti-skid features;

To provide a ladder support which is quick and easy to use;

To provide a ladder support which can accommodate practically all two-rail ladders in current use;

To provide a ladder support which is long-lasting and economical to repair:

To provide a ladder support which collapses into a flat compact unit for convenient handling and storage.

A further object is to provide a ladder safety device which imparts a real sense of security to the user. Since most field workers work alone, they have no second person to steady the ladder for them while working in uncertain situations. Thus this device allows the workers attention to be focused primarily on the immediate task, rather than being diverted to his or her personal safety.

Of particular advantage is the use of the four steel spikes during conditions of ice-crusted ground surfaces. By penetrating the ice crust with the steel spikes, the base plate becomes immovable.

Another further advantage is the time saved by eliminating time-consuming searches for flat objects which are necessary to prevent the ladder feet from sinking.

Yet another advantage is the simplicity of adjusting the device for a variety of surface slopes.

DRAWING FIGURES

REFERENCE NUMERALS IN DRAWING

| | |
|---|---|
| 10 base plate | 11 upwardly extending base plate edges |
| 12 load plate | 13 upwardly extending load plate edges |
| 14 support racks | 15 support rack latch springs |
| 16 support rack lifting springs | 17 wing nuts |
| 18 anti-skid spikes | 19 textured adhesive material |

DESCRIPTION—FIG. 1

Figure 1:
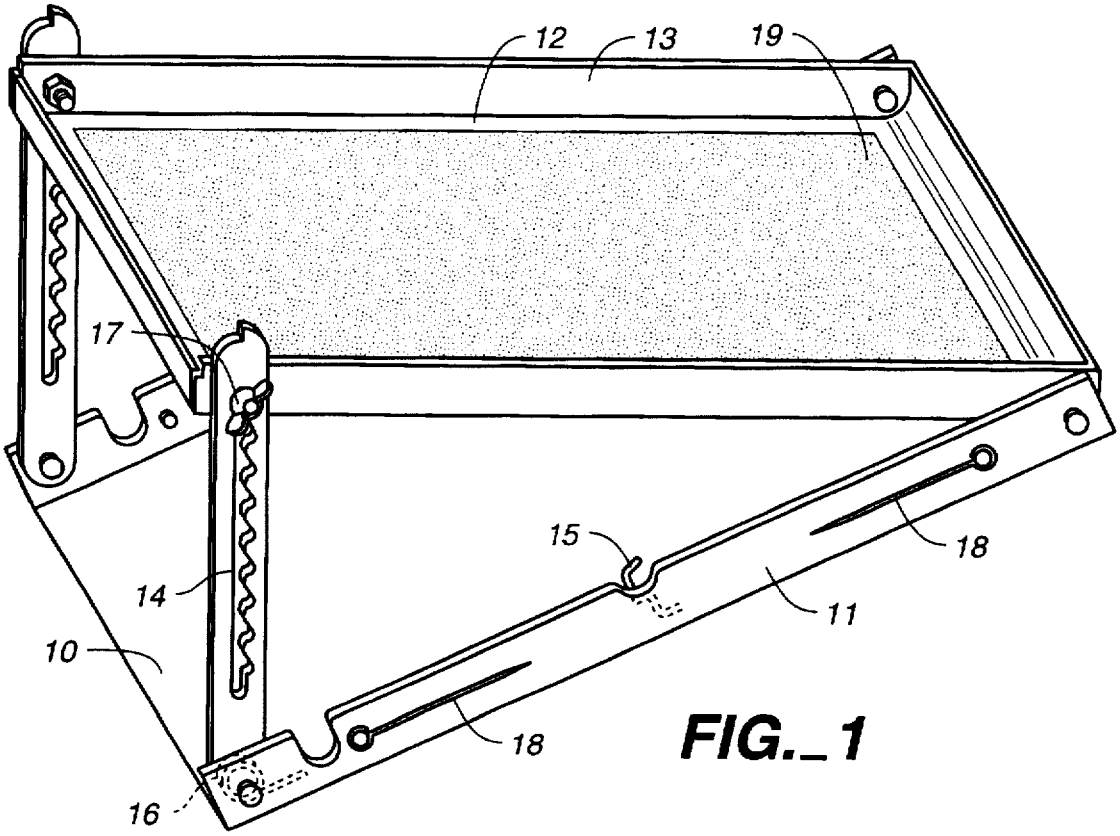
FIG. 1 is a perspective view showing all the major components of a ladder support in an inclined mode.

A preferred embodiment of an adjustable ladder supporting device, in accordance with my invention, is illustrated in FIG. 1. Viewed in an inclined mode, this perspective drawing shows a ladder supporting device which consists of four major components. These are: a rectangular base plate 10, formed of aluminum sheet metal, a load plate 12, similarly formed and shaped, which is attached to and pivotal upon base plate 10, and two supporting racks 14.

Base plate 10 has orthogonally extending edges 11 along both sides, to which load plate 12 and support arms 14 are attached by pinions, not shown. Load plate 12 has orthogonally extending edges 13 on sides and ends which prevent ladder feet from slipping off. The upwardly extended edge at the hinged end of load plate 12 is curved to permit rotational motion.

Support racks 14 are made of heavy gauge steel and are slotted and notched to provide the resting position for the moveable end of load plate 12. Two cinching wing nuts 17, one of which is shown, and bolts are provided to lock load plate 12 and support racks 14 together. Two support rack latching springs 15, one of which is shown, are attached in fixed positions to base plate 10. A pair of support rack lifting springs 16, one of which is shown, are indicated by a spiral broken line.

Four anti-skid steel spikes 18, two of which are shown, are attached to and pivotal upon base plate edges 11. The lower surface of base plate 10 and the upper surface of load plate 12 are covered with a textured, skid-resistant adhesive material 19, such as is used on stair treads.

Base plate 10 and load plate 12 preferably are made from 3.2 millimeter aluminum sheet metal. In one embodiment, base plate 10 measured 20 centimeters by 55 centimeters and thus had 1100 square centimeters of ground contact area. This greater ground contact area permits a reduction of ground pressure from 0.7 kilograms per square centimeter to 0.1 kilogram per square centimeter. Load plate 12 is slightly narrower than base plate 10 so that it can nest within base plate 10 when the device is collapsed.

OPERATION

Figure 2:
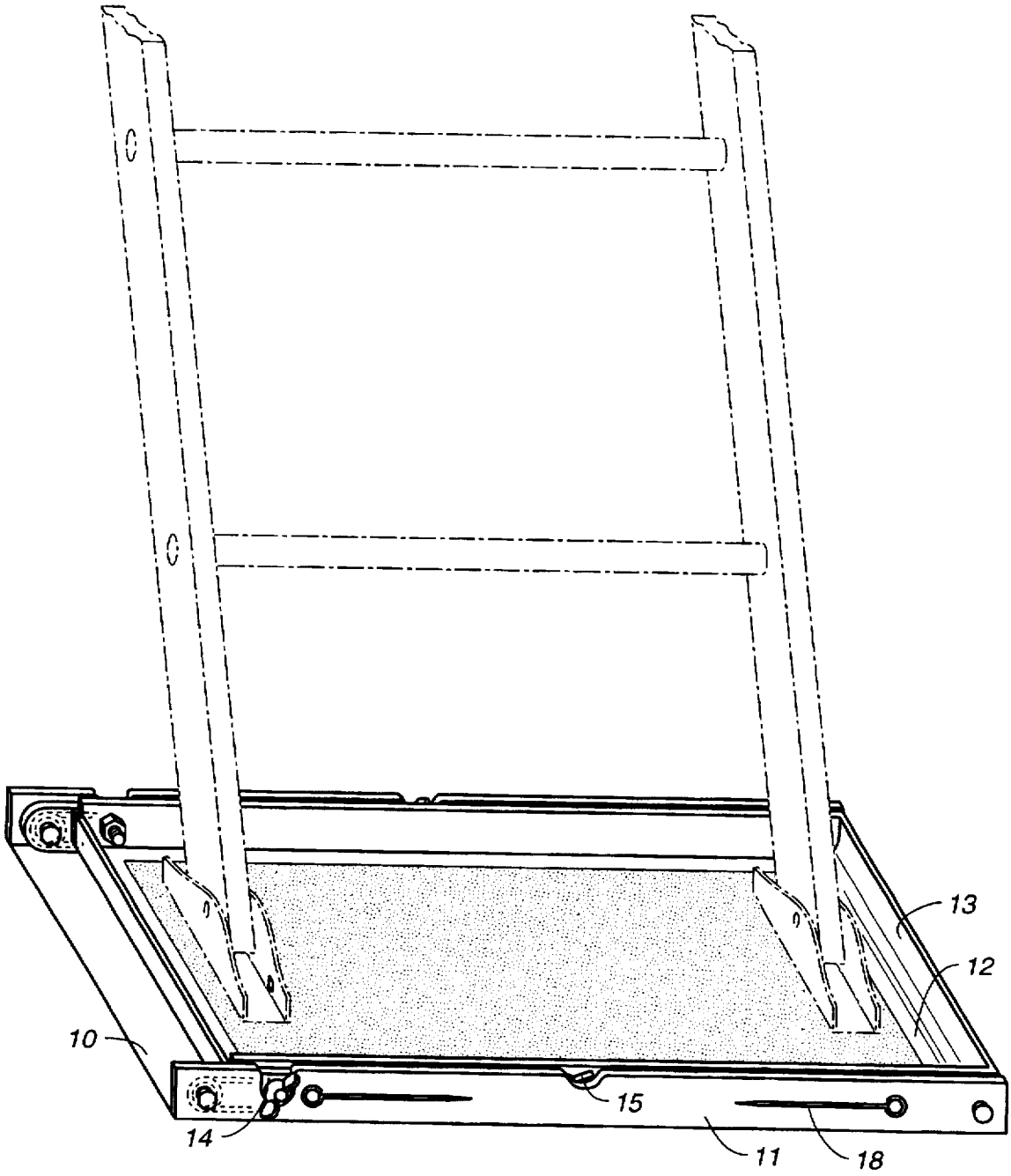
FIG. 2 shows a ladder situated upon a ladder support which is in the collapsed mode.
Figure 3:
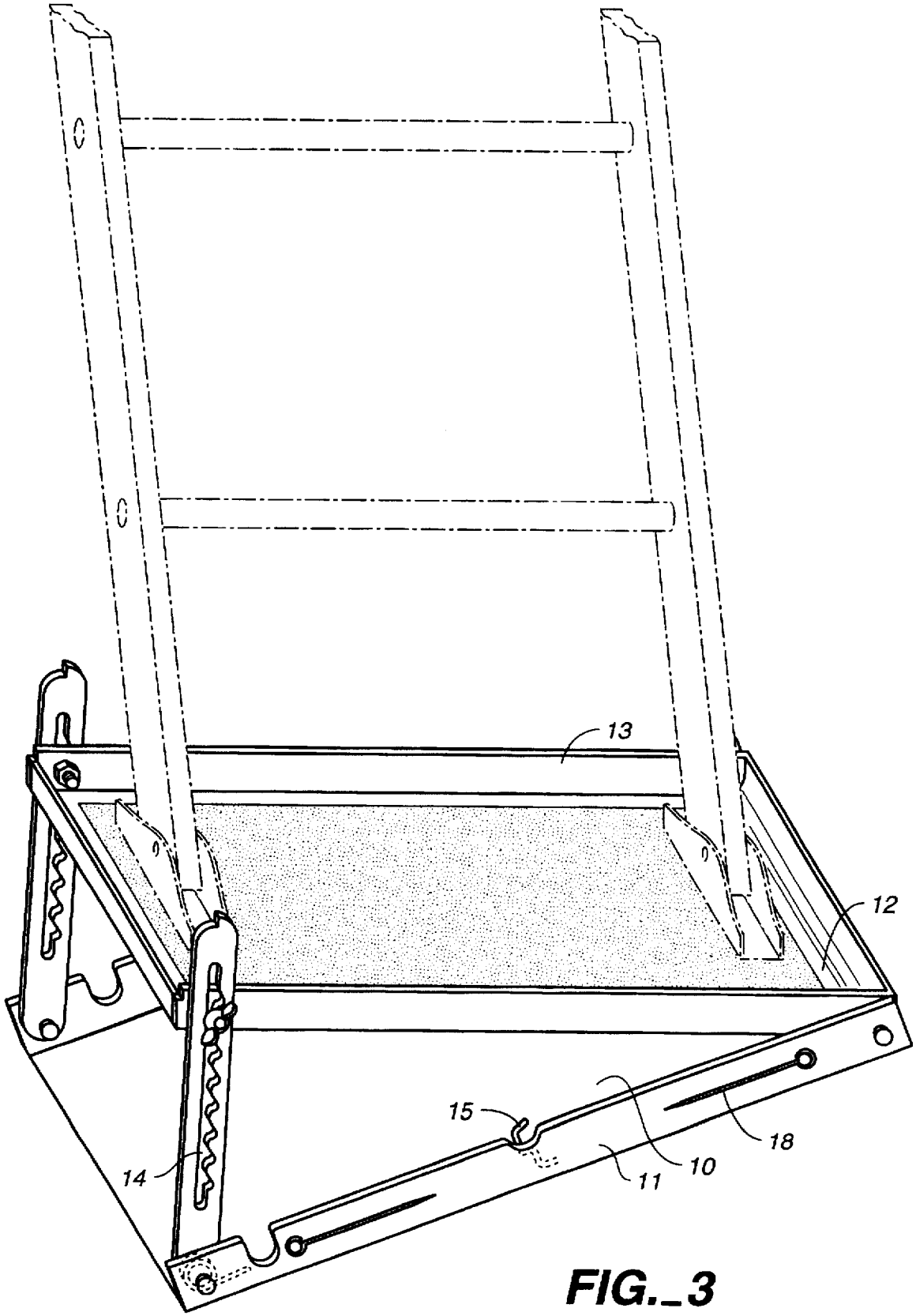
FIG. 3 show a ladder situated upon a ladder support which is in the inclined mode.

This ladder support is designed to be used in either of two modes of operation. FIG. 2 shows the ladder support in one mode wherein it is placed flat on the ground collapsed. In this mode, the latch springs prevent the support racks and the load plate from rising. FIG. 3 shows the ladder support in another mode wherein the load plate is angularly positioned and supported thusly by the two support racks.

The collapsed mode of operation is used when the ladder footing area is level but unstable. To use the ladder support in this mode, the worker merely clears away any debris and places the ladder support in position where the ladder feet need to rest. Then, as shown in FIG. 2, the ladder is placed upon the load plate. In this manner, the weight of the ladder plus that of the worker is distributed over the ground area covered by the base plate. As a result, the ladder is stabilized even though the footing area can be essentially unstable.

If the surface area where the ladder is to be placed is sloped, angular compensation is required. FIG. 3 shows the ladder support in the inclined mode with a ladder placed upon the load plate. To use the ladder in this mode, the worker clears the area, as above, and places the ladder support flat on the ground. The support racks are then released by using both thumbs to press the latch springs forward simultaneously. The support racks pivot upward by the force of the spiral springs and, in the same motion, carry the moveable end of the load plate upward so that it comes to rest in the lowest pair of notches of the support racks. If the required compensation angle is greater than that of the lowest position, the moveable end of the load plate is grasped and raised one notch at a time until the proper compensation angle is reached. The notches which are cut into the slots of the support racks are configured in such shape that, once the load plate has come to rest in a particular pair of notches, the load plate cannot come out of that position unless the moveable end is raised upward. This unique feature prevents accidental dislocation of the moveable end of the load plate. Lastly, the two wing nuts are tightened, which forces a secure contact between the inner surfaces of the support racks and the outer surfaces of the load plate edges, thus locking these members together. The entire assembly is then ready to be positioned in the proper location to support a ladder. The ladder is then placed upon the load plate.

If the worker determines that, for safety's sake, additional skid resistance would be helpful, the four steel spikes can be utilized. To use this safety feature, the worker pivots the four steel spikes downward and presses them into the surface of the ground as the assembly is being positioned to receive the ladder. The use of these safety spikes is particularly advantageous when the ladder support is to be used over ice crusted ground surfaces. Once the spikes have penetrated the ice crust, the ladder support is immovable.

After the job has been completed and the ladder has been removed, the ladder support is ready to be collapsed and stored. The wing nuts are loosened which releases the moveable end of the load plate from the support racks. Then, by slightly raising the moveable end of the load plate, it becomes free to move out of the resting notches. The support racks now can be pivoted downward against the force of the spiral springs. As the support racks pivot downward, they carry the movable end of the load plate downward until it is parallel within the base plate. As the support racks and the load plate come to nest within the base plate, the latch springs snap into place locking the assembly in the collapsed mode.

SUMMARY

In view of the foregoing disadvantages inherent in the known types of ladder leveling devices present in the prior art, the present invention provides an improved ladder support. The principle improvement is in the safety factor involved in ladder usage. Whereas most ladder levelers or stabilizers are subject to one or both feet sinking into soft footings, the main feature of the present invention is the broad-based solid support it provides. For this reason and design, it becomes virtually impossible for the ladder support to sink, which would cause the ladder to tilt or shift position. Thus my ladder support provides increased stability regardless of the workers body movement or weight shifting while engaged in work atop the ladder. This assurance of safety allows the worker to concentrate attention and effort in the performance of the immediate task. Furthermore, the present invention has been designed to be constructed of materials which have greater strength than would be required for normal operating loads.

Accordingly, the reader will perceive that my ladder support can be used by field workers easily, quickly, and conveniently. The ease with which a worker can (1) appraise the footing situation, (2) adjust the device to the proper configuration, and (3) be ready to place the ladder in position, cannot be over emphasized. The simplicity and reliability of my ladder support can easily be understood and appreciated by all field workers, from apprentices to experienced technicians. The monetary saving to employers, by the reduction of lost person-hours due to delays in work performance, is appreciable. More importantly, the saving, due to the reduction in injury and possible litigation, is both obvious and incalculable. The consistent use of this ladder support by field workers will give supervisory personal considerable peace of mind, knowing that many hazardous jobs can become quite routine. This is especially true during wintry or stormy conditions when ladders are particularly susceptible to slippage.

Since there are several alternative means of inclining a load bearing plate, my ladder support could be modified as follows:

1. By cutting the slots and notches into the orthogonally extended edges of either the base plate or the load plate and pivoting the support racks from the opposite plate, or 2. By providing four similar support racks, a pair at each end of the plates, or 3. By using a pair of scissor-type levers attached to the base plate and the moveable end of the load plate, or 4. By using a pair of threaded support rods attached to the base plate and working through a pair of mating collars which are attached to the load plate.

The major components of this ladder support are made of metal which provides sufficient strength to support a typical ladder load. In order to reduce production costs and/or weight, any of these components could be fabricated from plastic of sufficient strength.

I claim:

1. An adjustable ladder support for supporting a ladder on either a level or sloping surface; said support comprising a base member having a planar central portion with upwardly extending side walls; a platform member having a planar central portion with upwardly extending side walls; pivot means extending through respective side walls of said base and platform members pivotally joining the base and platform members at one end thereof; interlocking means for interlocking said base and platform members in a plurality of selected angular positions, said interlocking means comprising a pair of arms pivotally connected to the side walls of the base member at an opposite end thereof, said arms each having an internal elongated slot with a plurality of "S" shaped notches, and a pair of bolts connected to the side walls of the platform member for interlocking with selected one of said notches; further comprising a pair of springs at the pivotal connections of said arms for lifting the arms and biasing the notches into engagement with the bolts; a pair of latching springs connected to the base member for latching the pair of arms in a folded position with the arms and platform member nested within the base member; a plurality of steel spikes pivotally connected to the side walls of the base member and are adapted to pivot between a retracted position and an extended position in which said spikes can be engaged with a ground surface beneath said base member.

* * * * *